US012742361B2

(12) United States Patent
Allison et al.

(10) Patent No.: US 12,742,361 B2
(45) Date of Patent: Sep. 22, 2026

(54) PLUGGING DEVICE DEPLOYMENT IN SUBTERRANEAN WELLS

(71) Applicant: THRU TUBING SOLUTIONS, INC., Newcastle, OK (US)

(72) Inventors: Justin Allison, Owasso, OK (US); Roger L. Schultz, Ninnekah, OK (US); Brock W. Watson, Sadler, TX (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/936,215

(22) Filed: Nov. 4, 2024

(65) Prior Publication Data

US 2025/0154840 A1 May 15, 2025

Related U.S. Application Data

(60) Provisional application No. 63/599,006, filed on Nov. 15, 2023.

(51) Int. Cl.
*E21B 33/13* (2006.01)
*E21B 23/06* (2006.01)
*E21B 27/02* (2006.01)

(52) U.S. Cl.
CPC ..... *E21B 23/065* (2013.01)

(58) Field of Classification Search
CPC ..... E21B 33/138; E21B 27/02; E21B 43/11; E21B 43/261; E21B 43/25; E21B 33/13
See application file for complete search history.

(56) References Cited

U.S. PATENT DOCUMENTS

| | | | | |
|---|---|---|---|---|
| 2,892,405 | A * | 6/1959 | Chestnut | E21B 43/263 166/299 |
| 3,066,736 | A * | 12/1962 | Venghiattis | E21B 43/117 175/4.6 |
| 3,086,587 | A | 4/1963 | Zandmer et al. | |
| 3,292,700 | A | 12/1966 | Berry | |
| 3,302,581 | A * | 2/1967 | Burch | E21B 43/13 166/372 |
| 4,470,457 | A | 9/1984 | Lipatov et al. | |
| 4,535,842 | A * | 8/1985 | Ross | E21B 23/065 166/383 |
| 9,745,820 | B2 | 8/2017 | Watson et al. | |
| 9,745,847 | B2 | 8/2017 | Ditzler | |
| 9,810,036 | B2 | 11/2017 | Mailand et al. | |
| 10,934,809 | B2 * | 3/2021 | Becker | E21B 41/00 |
| 2010/0122813 | A1 * | 5/2010 | Trummer | E21B 33/02 166/255.1 |
| 2019/0162035 | A1 * | 5/2019 | Funkhouser | E21B 17/20 |
| 2020/0115977 | A1 * | 4/2020 | Norrid | E21B 23/065 |

(Continued)

OTHER PUBLICATIONS

Office Action issued Apr. 27, 2026 for U.S. Appl. No. 19/445,189, 20 pages.

*Primary Examiner* — Kipp C Wallace
(74) *Attorney, Agent, or Firm* — Smith IP Services, P.C.

(57) ABSTRACT

A method of deploying plugging devices into a subterranean well can include conveying a bottom hole assembly into the well, the bottom hole assembly including a plug deployment tool, and actuating the plug deployment tool, thereby gradually dispensing the plugging devices from an interior of the plug deployment tool into the well. The plugging devices may be dispensed from the plug deployment tool all at once, or in discrete intervals.

16 Claims, 8 Drawing Sheets

(56) References Cited

U.S. PATENT DOCUMENTS

| | | | | |
|---|---|---|---|---|
| 2020/0157902 | A1* | 5/2020 | Covalt | F16J 1/12 |
| 2023/0108571 | A1* | 4/2023 | Affleck | E21B 33/138<br>175/72 |

* cited by examiner

PLUGGING DEVICE DEPLOYMENT IN SUBTERRANEAN WELLS

CROSS-REFERENCE TO RELATED APPLICATION

This application claims the benefit of the filing date of U.S. provisional application No. 63/599,006 filed on 15 Nov. 2023. The entire disclosure of the prior application is incorporated herein by this reference in its entirety for all purposes.

BACKGROUND

This disclosure relates generally to equipment utilized and operations performed in conjunction with a subterranean well and, in an example described below, more particularly provides for plugging device deployment in a well.

Plugging devices may be used to block fluid flow through openings in wells in a variety of different operations. Typically, the plugging devices are deployed into a well simultaneously at the surface, after which the plugging devices are intended to engage and block flow through respective ones of the openings.

It will, therefore, be readily appreciated that improvements are continually needed in the art of deploying plugging devices in wells. The present specification provides such improvements.

DETAILED DESCRIPTION

Figure 1:
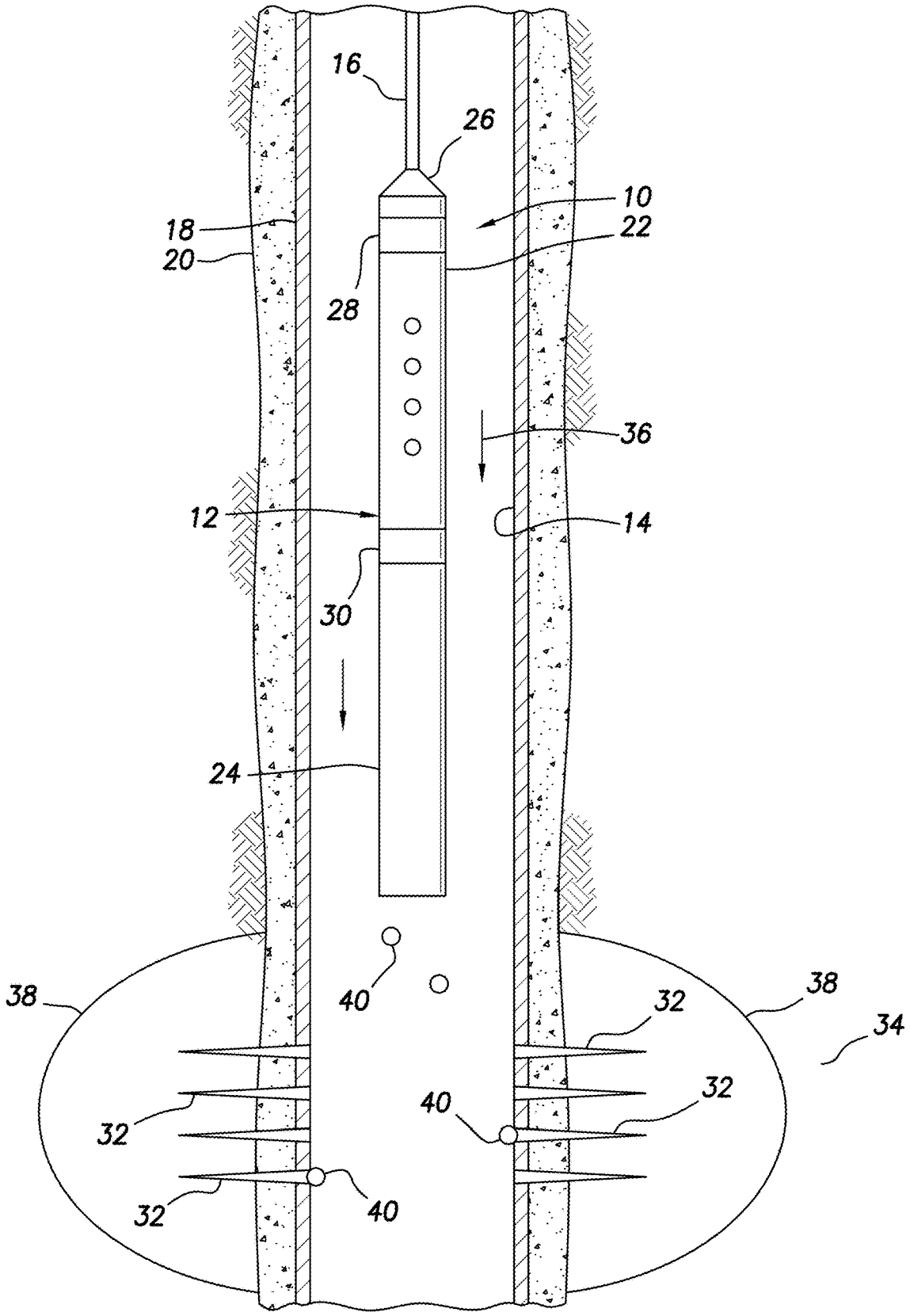
FIG. 1 is a representative partially cross-sectional view of an example of a well system and associated method which can embody principles of this disclosure.

Representatively illustrated in FIG. 1 is a plug deployment system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 system 10, a bottom hole assembly 12 is conveyed in a wellbore 14 using a conveyance 16. In this example, the wellbore 14 is lined with casing 18 and cement

20, but other techniques for lining the wellbore may be used in other examples. For convenience of illustration, the wellbore 14 is depicted as being generally vertical, but the wellbore may be horizontal or otherwise inclined from vertical in other examples.

As depicted in FIG. 1, the bottom hole assembly 12 includes a perforator 22 and a plug deployment tool 24. The bottom hole assembly 12 can also include a variety of different types of equipment, such as, a cable head 26, a firing head 28 for actuating the perforator 22 and a telemetry device 30 for actuating the tool 24. Additional equipment not shown in FIG. 1 can include a casing collar locator, a junk basket, a caliper, or any other type of equipment. Additional, fewer or different items of equipment may be included in the bottom hole assembly 12 in keeping with the scope of this disclosure.

The conveyance 16 may be any type of conveyance suitable for transporting the bottom hole assembly 12 in the wellbore 14. For example, the conveyance 16 may be wireline, slickline, coiled tubing, segmented tubing, an autonomous vehicle, a tractor, a robot, or another type of conveyance. Fluid flow could in some examples be used to convey the bottom hole assembly 12 through the wellbore 14.

The perforator 22 is used in the FIG. 1 example to form openings or perforations 32 through the casing 18 and cement 20 to thereby permit fluid communication between the wellbore 14 and an earth formation or zone 34 penetrated by the wellbore. The perforator 22 may be any type of perforator, such as, an abrasive jet, an explosive shaped charge, a projectile or a drill perforator. The perforator 22 may be actuated by any means, such as, using an electrical conductor of the conveyance 16, a telemetry signal from a remote location, manipulation of the conveyance, applied pressure, hydrostatic pressure, a time delay, or any other actuation means.

In the FIG. 1 example, the perforator 22 has formed the perforations 32, and then the bottom hole assembly 12 has been raised (displaced uphole) in the wellbore 14 to a position above (uphole of) the perforations. A fluid 36 is flowed through the wellbore 14 and through the perforations 32 into the formation 34, in order to form fractures 38 in the formation. The fluid 36 may include various materials, such as, proppant, viscosity modifiers, permeability enhancers, acid, gels, etc.

In other examples, the perforator 22 may not be used. Openings may be formed or opened to permit or enhance fluid communication between the wellbore 14 and the formation 34 by other means (such as, valves, frangible plugs, etc.). It is not necessary for the wellbore 14 to be initially isolated from the formation 34 by casing 18 or cement 20.

In the FIG. 1 example, the plug deployment tool 24 is used to dispense plugs or plugging devices 40 into the wellbore 14 after the fractures 38 have been formed. The plugging devices 40 are conveyed by the fluid 36 into sealing engagement with the perforations 32 to thereby prevent (or at least substantially restrict) flow from the wellbore 14 into the formation 34. In this manner, another formation or zone penetrated by the wellbore 14 can subsequently be fractured without substantial loss of fluid into the already-fractured zone.

The plugs or plugging devices 40 may comprise any type of structure, material or substance capable of preventing (or at least substantially restricting) flow through the openings or perforations from the wellbore 14 to the fractured formation or zone 34. The plugging devices 40 may be of the types described in U.S. Pat. Nos. 10,641,069, 9,523,267 or 10,851,615, each of which is incorporated herein by this reference in its entirety for all purposes. The plugging devices 40 may comprise solid bodies, powdered or particulate material, or gel. The scope of this disclosure is not limited to use of any particular type of plugging devices.

It is desired, in this example, to control a rate of dispensing of the plugging devices 40 into the wellbore 14. It is contemplated that controlled dispensing of the plugging devices 40 will result in more effective dispersal of the plugging devices in the wellbore, engagement of the plugging devices with the perforations 32, and blocking of fluid flow into the formation 34. The plug deployment tool 24 includes features, described more fully below, to accomplish this controlled dispensing of the plugging devices 40.

The tool 24 may be actuated by any means, such as, using an electrical conductor of the conveyance 16, a telemetry signal from a remote location, manipulation of the conveyance, applied pressure, hydrostatic pressure, a time delay, or any other actuation means. For convenience, examples of the tool 24 described below are actuated using electrical current delivered via an electrical conductor of the conveyance 16.

Note that, in the FIG. 1 example, the tool 24 is positioned in the wellbore 14 between the perforator 22 and the previously formed perforations 32 when the plugging devices 40 are released from the tool into the wellbore. In this manner, the plugging devices 40 can be dispensed from a bottom end of the tool 24, and the fluid 36 can readily convey the plugging devices 40 to the perforations. In other examples, the tool 24 may not be positioned between the perforator 22 and the perforations 32 when the plugging devices 40 are released from the tool into the wellbore 14.

Figure 2:
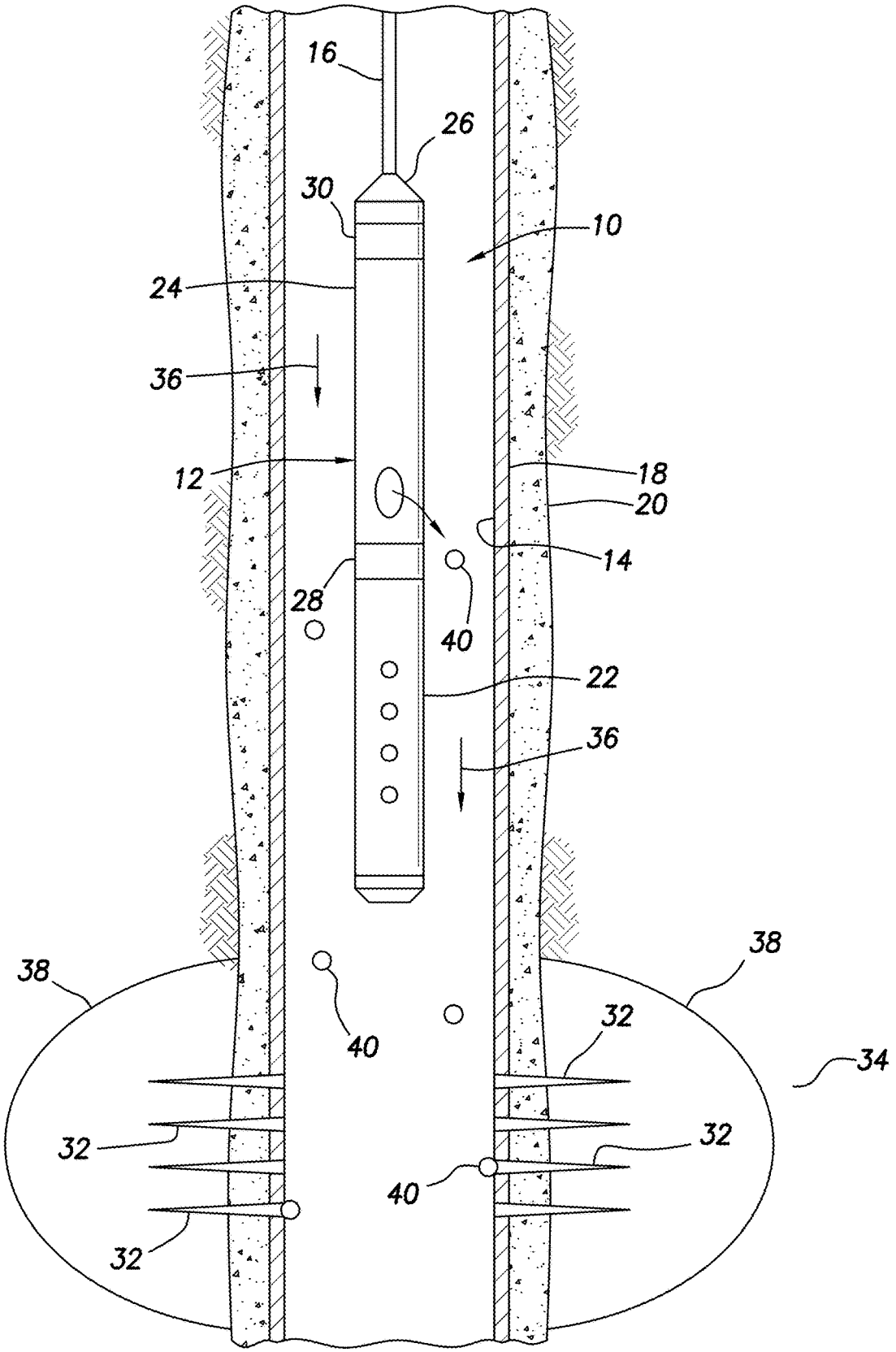
FIG. 2 is a representative partially cross-sectional view of another example of a well system and associated method which can embody principles of this disclosure.

Referring additionally now to FIG. 2, another example of the system 10 is representatively illustrated. In this example, the tool 24 is connected in the bottom hole assembly 12 between the conveyance 16 and the perforator 22. Thus, the tool 24 is connected above, instead of below, the perforator 22. In other examples, the tool 24 could be connected between perforators 22.

As depicted in FIG. 2, the plugging devices 40 are being dispensed from a side of the tool 24, instead of from a bottom end of the tool as in the FIG. 1 example. The plugging devices 40 are dispensed from the tool 24 in the FIG. 2 example after the perforations 32 have been formed through the casing and cement 18, 20, and after the fractures 38 have been formed. However, it is not necessary for the tool 24 to be used with a perforating, stimulating, treating, fracturing or any other particular type of well operation.

Note that, in each of the FIGS. 1 & 2 examples, the fluid 36 used to fracture, treat and/or stimulate the formation or zone 34 is not necessarily identical to the fluid that conveys the plugging devices 40 into sealing engagement with the openings or perforations 32.

Figure 3A:
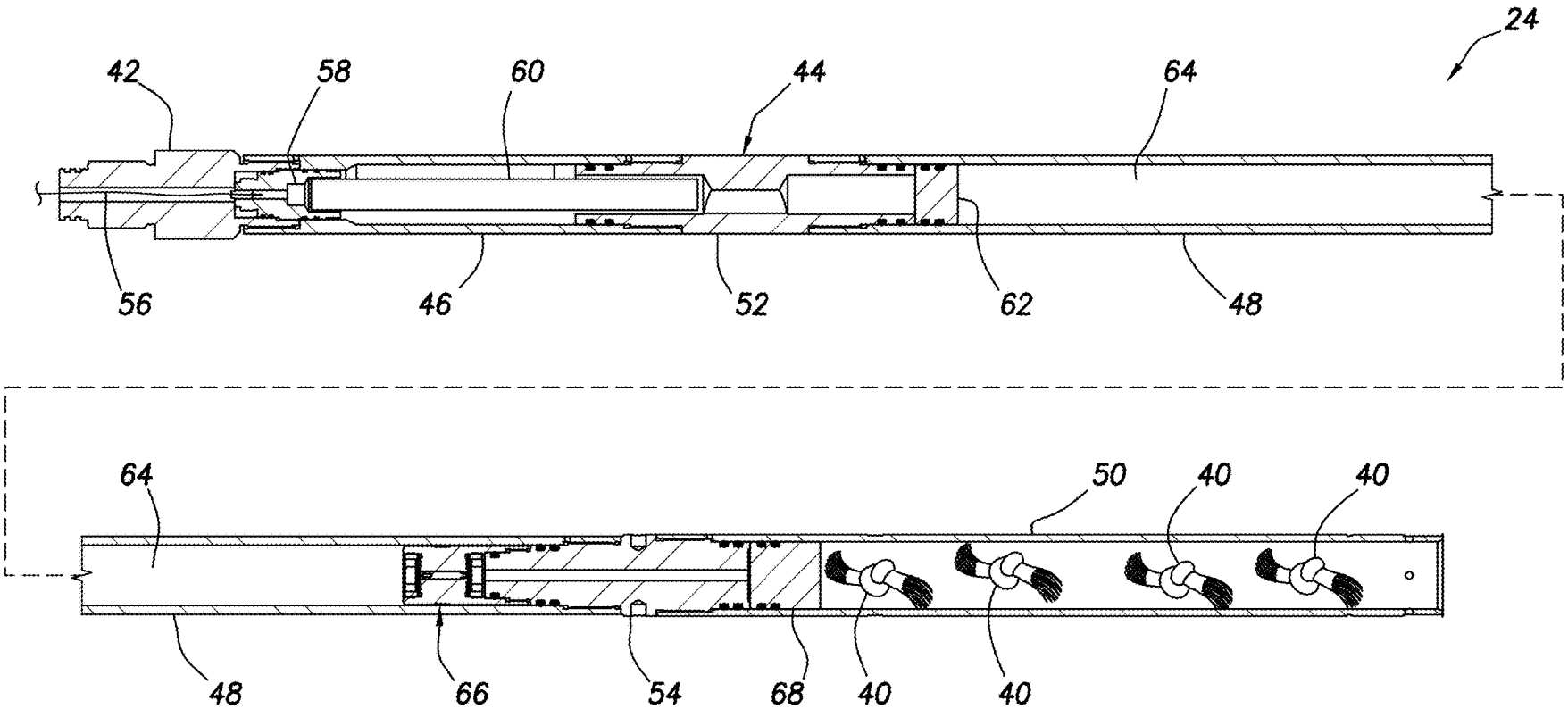
FIG. 3A is a representative cross-sectional view of an example of a plug deployment tool which can embody principles of this disclosure.

Referring additionally now to FIG. 3A, a more detailed cross-sectional view of an example of the plug deployment tool 24 is representatively illustrated. The FIG. 3A tool 24 may be used with the FIGS. 1 & 2 systems 10 and methods, or it may be used with other systems and methods.

In the FIG. 3A example, the tool 24 includes a threaded upper connector 42 and an outer housing assembly 44. The outer housing assembly 44 includes upper, intermediate and lower generally tubular housings 46, 48, 50 and threaded connectors 52, 54 connecting the housings to each other. Other numbers or configurations of housings and connectors may be used in other examples.

An electrical conductor 56 extends through the upper connector 42 to a pyrotechnic initiator 58. The electrical conductor 56 may be part of, or included in, the conveyance 16, or it may extend to the telemetry device 30 or another device used to actuate the tool 24. When appropriate electrical current is delivered to the initiator 58 via the conductor 56, the initiator will ignite or combust.

A power charge 60 is positioned in the upper housing 46 proximate the initiator 58. When the initiator 58 ignites or combusts, the power charge 60 will then ignite or combust, thereby producing high pressure gas (e.g., greater than hydrostatic pressure in the wellbore 14 external to the tool 24 in the FIGS. 1 & 2 examples) in the upper housing 46. The power charge 60 in this example is the same as, or similar to, that known to those skilled in the art as being conventionally used in a plug or packer setting tool (such as, the Baker™ #10 or #20 setting tool), although other types of power charges or propellants may be used in other examples.

A piston 62 is sealingly and reciprocably received in an upper end of the intermediate housing 48. Fluid 64 (such as, a hydraulic fluid, ethylene glycol, water, etc.) is contained in the intermediate housing 48 below the piston 62. The gas pressure generated by the power charge 60 is transmitted via the connector 52 to the interior of the intermediate housing 48. The piston 62 isolates the gas from the fluid 64, while permitting the gas pressure to be applied to the fluid.

The pressurized fluid 64 flows from the interior of the intermediate housing 48 through a fluid metering device 66 at an upper end of the connector 54. The fluid metering device 66 is configured to regulate flow of the fluid 64 from the interior of the intermediate housing 48 to an interior of the lower housing 50. In some examples, the metering device 66 may be capable of maintaining a substantially constant predetermined flow rate of the fluid 64 through the metering device.

The metering device 66 may comprise any device suitable for regulating the flow of the fluid 64 (such as, a pressure compensated flow control valve). In various examples, the metering device 66 may include an orifice, tortuous flow path, helical flow path, fluidic flow restrictor, vortex chamber, combinations of these, or any other fluid metering element.

Another piston 68 is sealingly and reciprocably positioned in an upper end of the lower housing 50. The fluid 64 metered through the metering device 66 flows through the connector 54 and into an interior of the lower housing 50 above the piston 68. As the pressure of the fluid 64 above the piston 68 exceeds hydrostatic pressure in the wellbore 14, the piston displaces through the lower housing 50.

A velocity of the piston 68 displacement will be constant or substantially constant, if the flow rate of the fluid 64 through the metering device 66 is constant or substantially constant. The velocity of the piston 68 can be varied as desired by appropriately configuring the metering device 66 to permit flow of the fluid 64 therethrough at a corresponding flow rate.

The plugging devices 40 are initially contained in the lower housing 50 below the piston 68. A retainer 70 releasably secures the plugging devices 40 in the interior of the lower housing 50 while the tool 24 is being conveyed in the wellbore 14 and prior to displacement of the piston 68 by the fluid 64 flow into the lower housing above the piston.

Figure 3B:
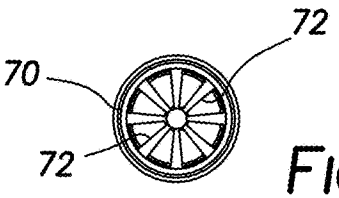
FIG. 3B is a representative end view of an example of a plug retainer of the plug deployment tool.

Although shown separate from the lower housing 50 in FIG. 3B, the retainer 70 is connected at a lower end of the lower housing in use. The retainer 70 includes flexible fingers 72 that releasably retain the plugging devices 40, but permit the plugging devices to be pushed out of the lower housing 50 when the piston 68 pushes downward against the plugging devices.

When the piston 68 displaces downward (preferably at a constant or substantially constant velocity), the plugging devices 40 will be gradually pushed downward and out of the lower housing 50 via the retainer 70. In this way, the plugging devices 40 are dispensed from the tool 24 in a controlled manner. Note that it is not necessary for the piston 68 to displace at a constant or substantially constant speed for the plugging devices 40 to be dispensed gradually or one-at-a-time from the lower housing 50.

Figure 4:
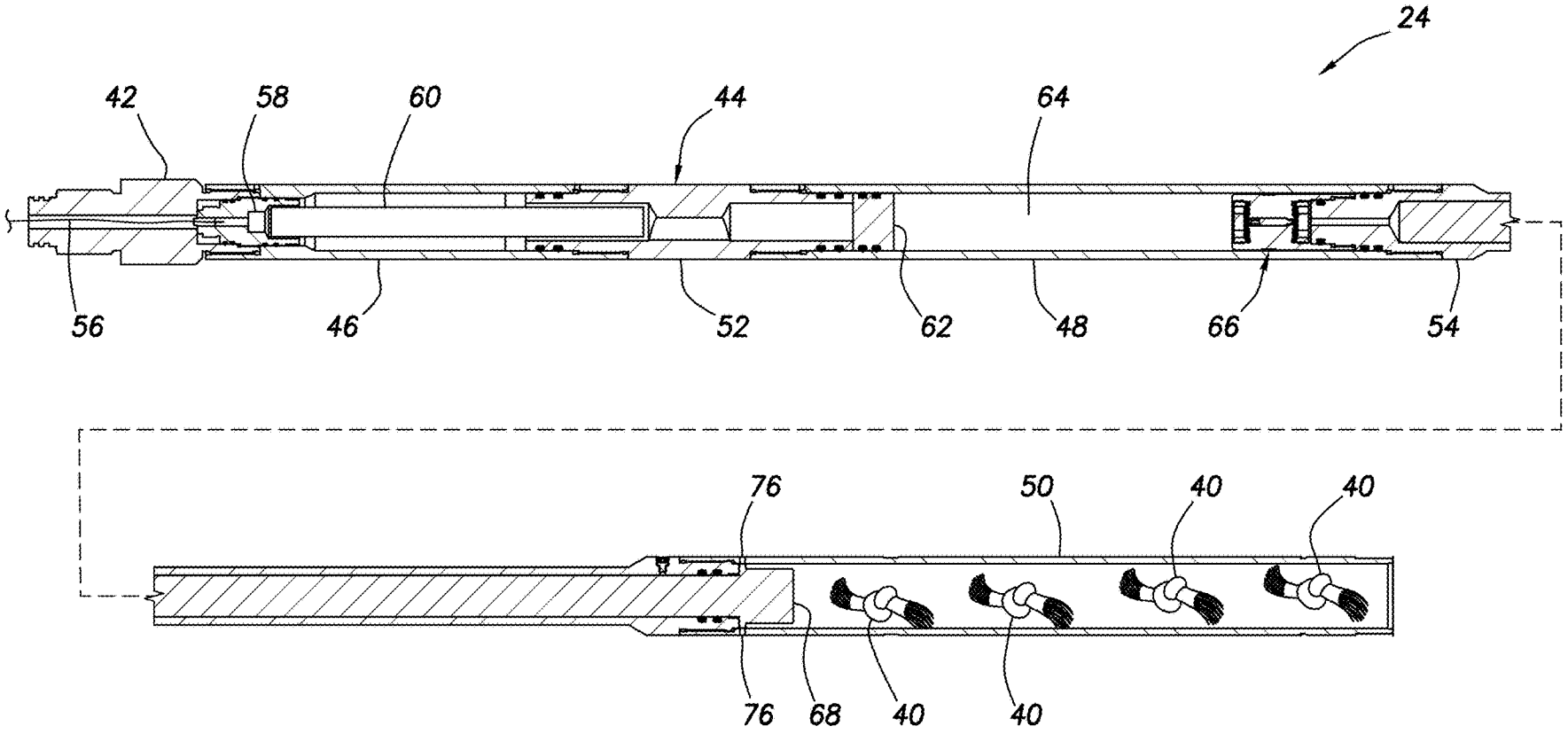
FIG. 4 is a representative cross-sectional view of another example of the plug deployment tool.

Referring additionally now to FIG. 4, another example of the tool 24 is representatively illustrated. The FIG. 4 example is similar in many respects to the FIG. 3A example, but the FIG. 4 example includes differently configured connector 54 and piston 68.

As depicted in FIG. 4, the piston 68 is sealingly received in the connector 54, instead of in the lower housing 50. In addition, a piston area of the piston 68 is smaller than that of the FIG. 3A example. As a result, a smaller volume of the fluid 64 is required to displace the piston 68 a given distance.

This allows the intermediate housing 48 to be shorter as compared to the FIG. 3A example. In addition, ports 76 can be formed in the lower housing 50 to provide for well fluid infiltration and pressure equalization in the lower housing.

In other respects, the FIG. 4 example operates in the same or similar manner as the FIG. 3A example. Note that the retainer 70 is not depicted in FIG. 4, but preferably the retainer 70 would be connected at a lower end of the lower housing 50.

Figure 5:
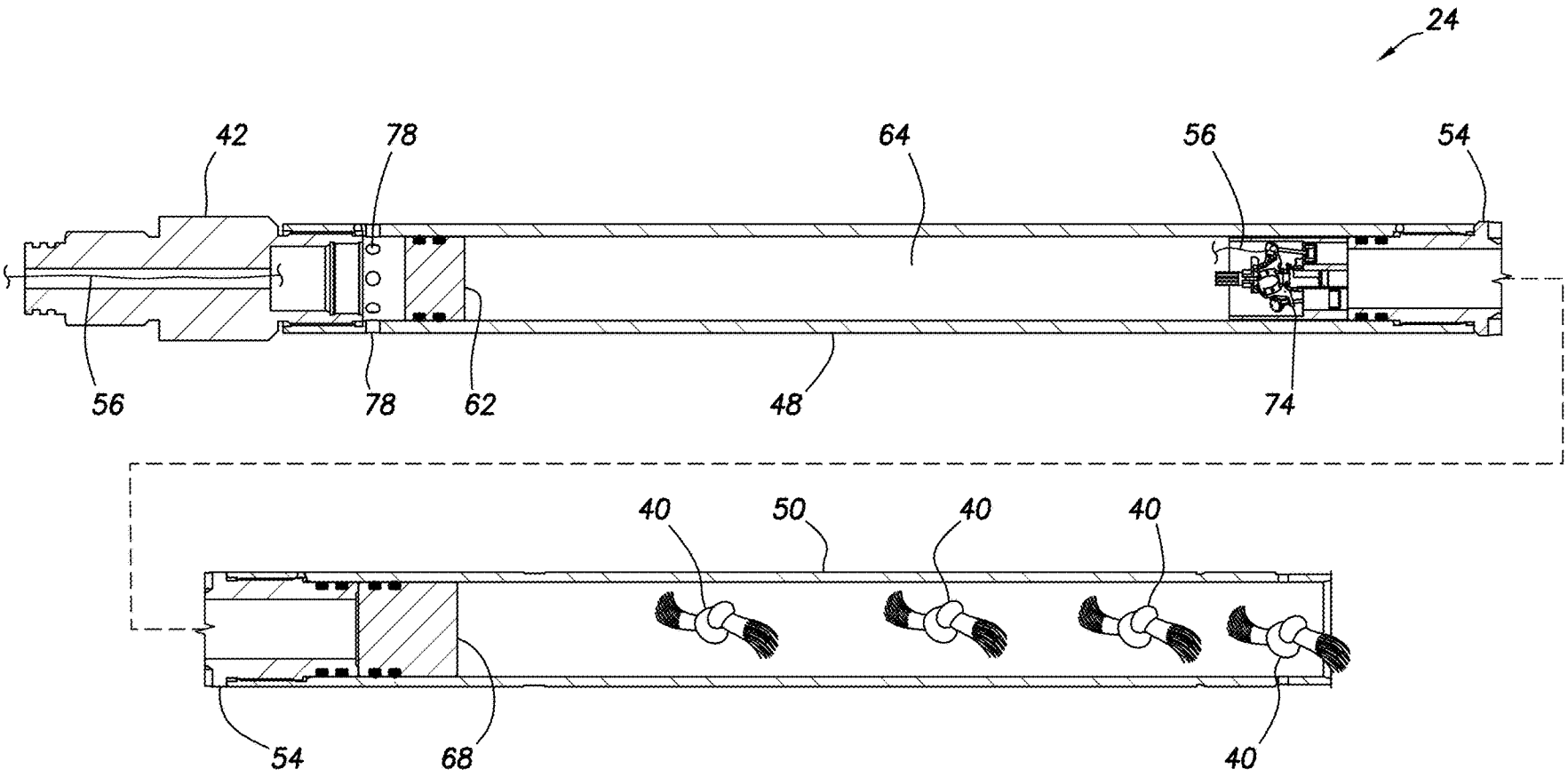
FIG. 5 is a representative cross-sectional view of another example of the plug deployment tool.

Referring additionally now to FIG. 5, another example of the plug deployment tool 24 is representatively illustrated. In this example, the upper housing 46, connector 44, initiator 58, power charge 60 and metering device 66 are not used. Instead, a pump 74 is used to transfer the fluid 64 from the interior of the housing 48 to the interior of the housing 50 above the piston 68. Ports 78 formed in the housing 48 provide for pressure balancing across the piston 62.

The pump 74 may be operated by electrical current delivered to the pump via the electrical conductor 56. In other examples, a battery or other electrical power source may be used. The pump 74 may comprise a brushless DC motor.

Preferably, the pump 74 is configured to flow the fluid 64 at a desired predetermined flow rate, so that the piston 68 is displaced through the lower housing 50 at a desirably controlled velocity. In this way, the plugging devices 40 are pushed out of the lower end of the lower housing 50 in a controlled manner. Note that the retainer 70 is not depicted in FIG. 5, but preferably the retainer 70 would be connected at a lower end of the lower housing 50.

The pump 74 can be actuated at multiple different times to thereby discharge one or more plugging devices 40 from the tool 24 at the different times (e.g., at discrete intervals). For example, the pump 74 could be actuated to discharge one or more plugging devices 40, and then at a subsequent time (such as, after another zone has been perforated and/or treated) the pump could again be actuated to discharge another one or more plugging devices.

Figure 6:
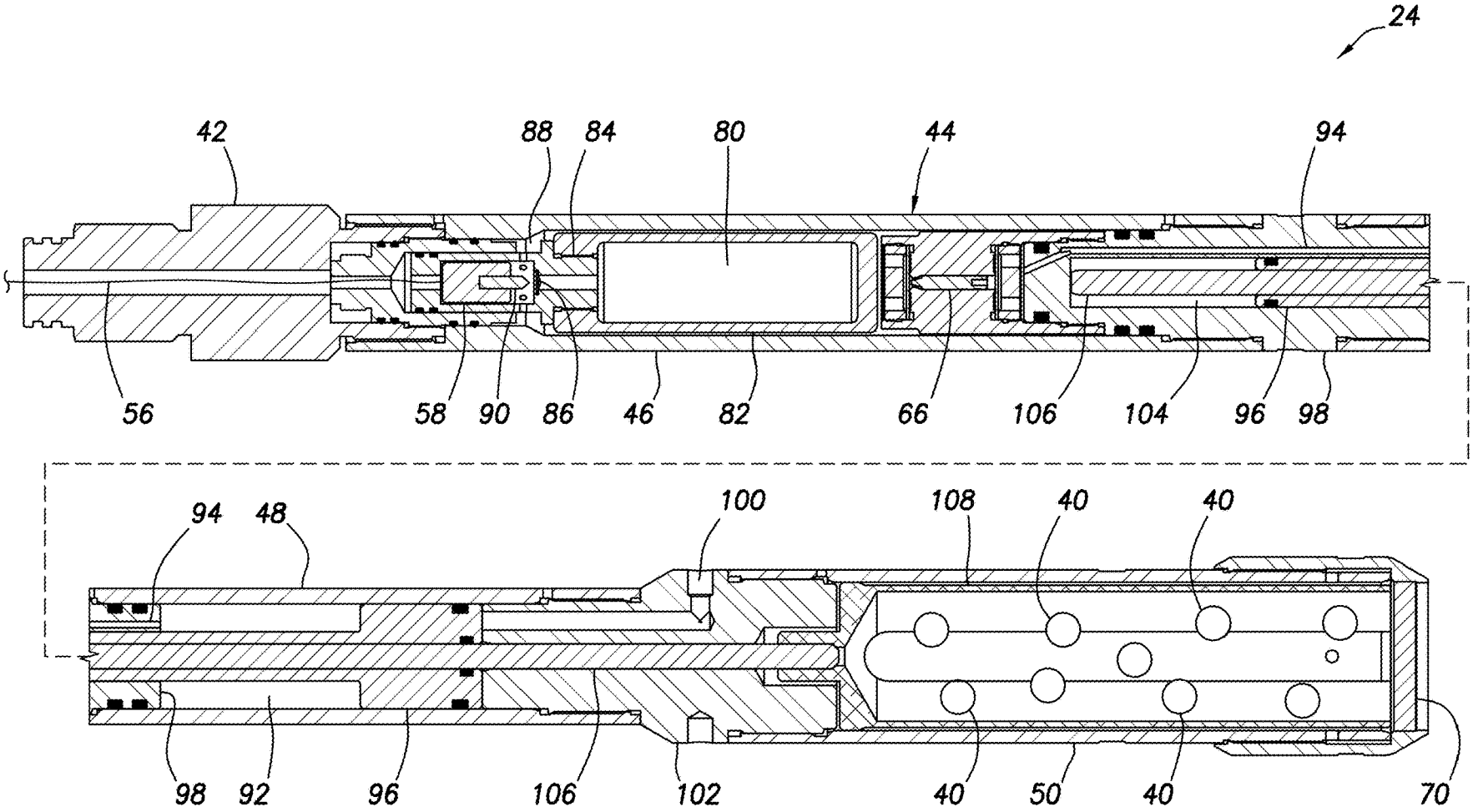
FIG. 6 is a representative cross-sectional view of another example of the plug deployment tool.
Figure 7:
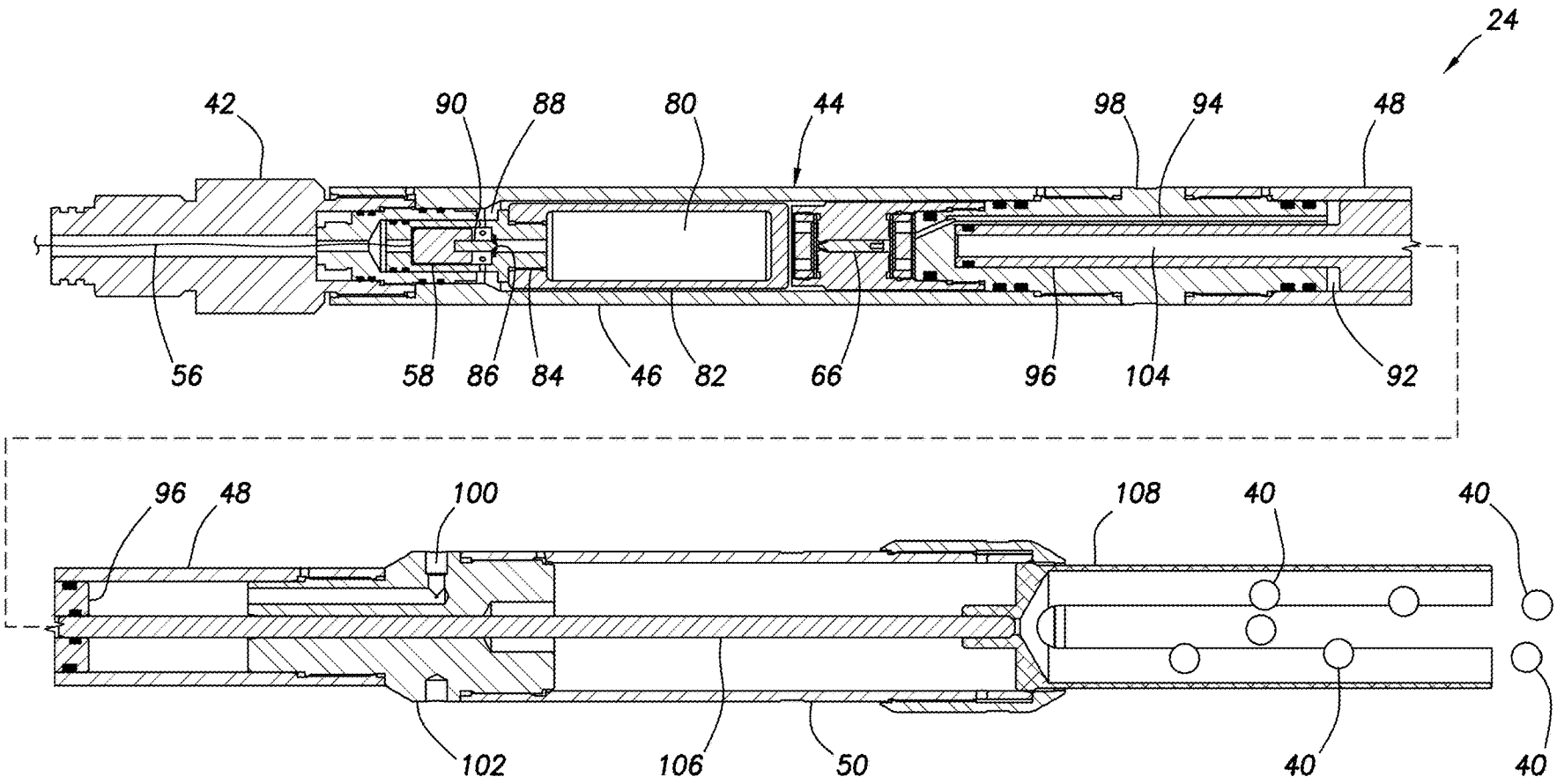
FIG. 7 is a representative cross-sectional view of the FIG. 6 plug deployment tool in an actuated configuration.

Referring additionally now to FIGS. 6 & 7, another example of the plug deployment tool 24 is representatively illustrated. In the FIGS. 6 & 7 example, the tool 24 includes an atmospheric (or other suitably low pressure) chamber 80 to provide a pressure differential for displacing the plugging devices 40 out of the lower housing 50.

As depicted in FIG. 6, the atmospheric chamber 80 is disposed in a sealed container 82 positioned in the upper housing 46. In some examples, the container 82 may be hermetically sealed with welded, silver soldered or otherwise airtight sealed connections (preferably without use of any elastomeric or polymer seals). For example, in the FIG. 6 example, an upper threaded connection 84 may be welded or silver soldered closed after the threaded connection is made.

At an upper end of the atmospheric chamber 80, a penetrable closure 86 isolates the atmospheric chamber from another volume 88, a portion of which surrounds the container 82 (e.g., between the container and the upper housing 46). The closure 86 may be structurally similar to a rupture disk, although in the FIG. 6 tool 24, the closure is not designed to be ruptured by fluid pressure.

A pointed pin or piercing member 90 is positioned above the closure 86. When the initiator 58 is actuated (e.g., using electrical current via the electrical conductor 56), the piercing member 90 will be propelled or driven downward toward the closure 86 to thereby pierce the closure 86 and permit fluid communication between the atmospheric chamber 80 and the volume 88.

A variety of different devices or mechanisms may be used to displace the piercing member 90, or to otherwise place the atmospheric chamber 80 in fluid communication with the volume 88 in other examples. The piercing member 90 could be displaced by an electrical motor instead of by the initiator 58. The piercing member 90 could be initially retained by a eutectic or other degradable material retainer that releases the piercing member to be propelled by a spring or other biasing device when desired (for example, a eutectic material could be heated due to the current transmitted by the electrical conductor 56). Instead of using the piercing member 90, the closure 86 could be breached directly by the ignited or combusted initiator 58. Any suitable type of valve could instead be used to selectively permit fluid communication between the atmospheric chamber 80 and the volume 88. The scope of this disclosure is not limited to any particular device, mechanism or technique for placing the chamber 80 in fluid communication with the volume 88.

The volume 88 is filled with a fluid, such as a hydraulic fluid, oil, etc. The volume 88 is in fluid communication with an annular chamber 92 in the intermediate housing 48. The chamber 92 is also fluid-filled. The volume 88 and the chamber 92 are in communication via a fluid passage 94 and the metering device 66.

The annular chamber 92 is disposed radially between the housing 48 and an annular piston 96 sealingly and reciprocably received in the housing 48 and a connector 98 between the upper and intermediate housings 46, 48. The annular chamber 92 is disposed axially between the connector 98 and a radially enlarged lower portion of the piston 96. A lower side of the piston 96 is exposed to well pressure via a port 100 formed in a threaded connector 102 between the intermediate and lower housings 48, 50.

When the closure 86 is pierced (or the atmospheric chamber 80 is otherwise placed in fluid communication with the volume 88), the fluid in the annular chamber 92 will be permitted to flow through the metering device 66 into the volume 88, and the fluid in the volume 88 will be permitted to flow into the chamber 80. The piston 96 will be displaced upward (to the left as viewed in FIG. 6) due to the well pressure acting on the lower side of the piston.

Another fluid-filled annular chamber 104 is disposed radially between the connector 98 and a rod piston 106 sealingly and reciprocably received in the annular piston 96. The annular chamber 104 is disposed above an upper end of the annular piston 96.

When the annular piston 96 displaces upward, the fluid (such as, hydraulic fluid, oil, etc.) will act on the rod piston 106 to thereby displace the rod piston downward through the annular piston. A lower end of the rod piston 106 is connected to a magazine or retainer 108 disposed in the lower housing 50. The plugging devices 40 are retained in the retainer 108 above the lower retainer 70 at a lower end of the housing 50.

As viewed in FIG. 7, the piercing member 90 has been propelled downward by actuation of the initiator 58. The atmospheric chamber 80 has been placed in fluid communication with the volume 88. Fluid in the volume 88 has flowed into the atmospheric chamber 80 through the closure 86 pierced by the member 90.

The annular piston 96 has displaced upward, forcing the fluid in the chamber 92 through the fluid passage 94 and the metering device 66 into the volume 88 and thence into the chamber 80. The metering device 66 ensures that the piston 96 displaces upward at a constant, or substantially constant, velocity due to a constant or substantially constant flow rate of the fluid through the metering device.

Note that it is not necessary in any of the examples described herein for the metering device 66 to ensure a constant or substantially constant rate of flow through the metering device. The flow rate may vary somewhat from an initial flow rate to a subsequent flow rate. Preferably, however, the metering device 66 does produce a regulated flow rate that enables the plugging devices 40 to be discharged in a controlled manner from the tool 24.

As depicted in FIG. 7, the rod piston 106 has displaced downward due to the upward displacement of the annular piston 96. The retainer 108 has displaced downward with the rod piston 106. As a result, the retainer 108 and the plugging devices 40 are pushed outward from the tool 24 through the retainer 70. Thus, the plugging devices 40 are discharged from the tool 24 in a controlled manner.

Figure 8:
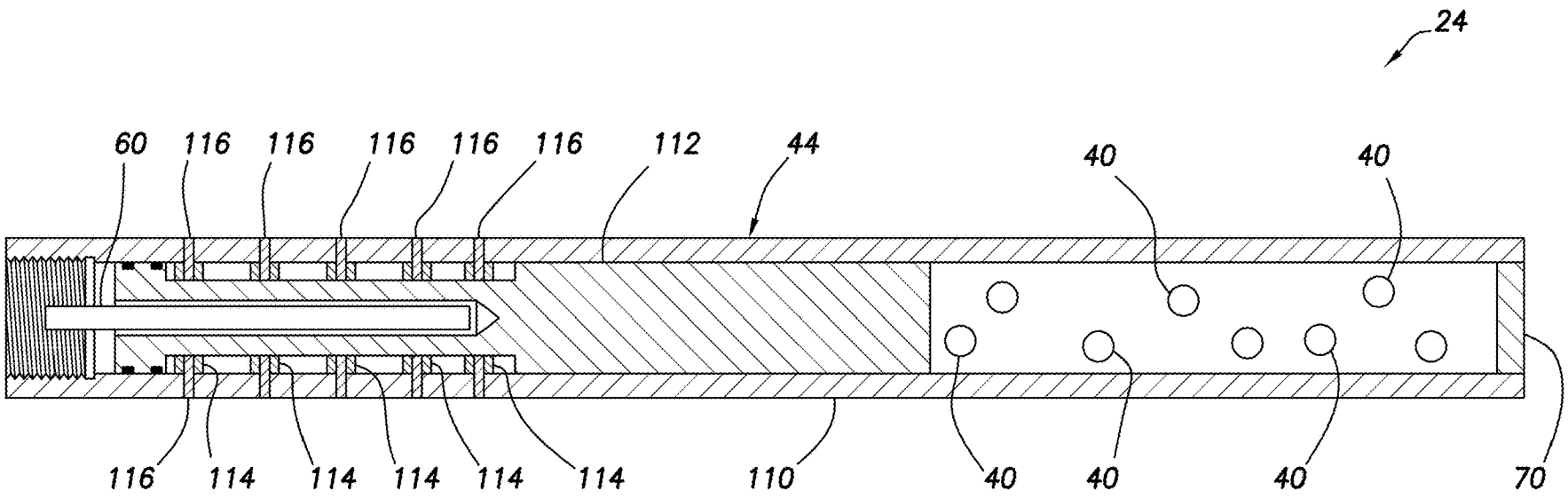
FIG. 8 is a representative cross-sectional view of another example of the plug deployment tool.

Referring additionally now to FIG. 8, another example of the plug deployment tool 24 is representatively illustrated. In the FIG. 8 example, the fluid metering device 66 is not used. In addition, the outer housing assembly 44 includes a single tubular housing 110 (although multiple housings may be used in other examples).

Although not shown in FIG. 8, the upper connector 42 and initiator 58 would be connected at an upper end of the housing 110. When the initiator 58 is ignited or combusted (e.g., due to electrical current delivered to the initiator), the power charge 60 will then ignite or combust, thereby producing high pressure gas (e.g., greater than hydrostatic pressure in the wellbore 14 external to the tool 24) in the housing 110 above a piston 112 sealingly and reciprocably received in the housing. In this example the power charge 60 is received in an upper end of the piston 112.

When the gas pressure generated by the power charge 60 exceeds the well pressure acting on a lower side of the piston 112, the piston will be biased to displace downward. A series of axially spaced apart rings 114 are disposed between the housing 110 and the piston 112 below a radially enlarged upper portion of the piston. Shear members 116 (such as, shear pins, shear screws, etc.) or other type of retainer members (such as, snap rings, collets, etc.) releasably retain the rings 114.

The piston 112 will displace downward somewhat (if it is not already in contact with the uppermost ring 114) and the gas pressure acting on the upper side of the piston 112 will then be transmitted to the shear members 116 retaining the uppermost ring. When the gas pressure sufficiently exceeds the well pressure, the shear members 116 will shear and the piston 112 will displace downward, until the next ring 114 is contacted.

The downward displacement of the piston 112 will then pause, until the gas pressure again builds up sufficiently to shear the shear members 116 retaining the second contacted ring 114. Thus, the downward displacement of the piston 112 will be repeatedly paused as each ring 114 is contacted in succession. In this way, the piston 112 displaces downward in a controlled manner through the housing 110.

The plugging devices 40 are contained in the housing 110 below the piston 112. The retainer 70 initially retains the plugging devices 40 in the housing 110. When the piston 112 displaces downward, the plugging devices 40 are discharged in a gradual, controlled manner (e.g., at discrete intervals) from the housing 110.

It may now be fully appreciated that the above disclosure provides significant advancements to the art of deploying plugging devices into a well. In examples described above, a plug deployment tool 24, system 10 and method enable plugging devices 40 to be dispensed from the tool in a controlled manner to thereby effectively block flow through openings (such as perforations 32, valve openings, etc.) in a well.

All of the plugging devices 40 may dispensed from the tool 24 in response to a single actuation of the tool. Alternatively, less than all of the plugging devices 40 may be dispensed from the tool 24 in response to a first actuation of the tool, and additional plugging devices may be dispensed from the tool in response to another actuation of the tool (e.g., as in the FIGS. 5 & 8 examples). Thus, the plugging devices 40 can be dispensed at discrete intervals from the tool 24.

The plug deployment tool 24 can be connected above, below or between one or more perforators 22.

The plug deployment tool 24 may include a power charge 60 for generating pressure to displace plugging devices 40 out of the tool. The pressure may act on a piston 68 which pushes the plugging devices 40 out of the tool 24. The plug deployment tool 24 may include a fluid metering device 66 to regulate a rate of displacement of the plugging devices 40 out of the tool. The fluid metering device 66 may include an orifice, tortuous flow path, helical flow path, fluidic flow restrictor, vortex chamber or other device for regulating flow of a fluid.

After flowing through the metering device 66, the fluid 64 may act on the piston 68 which pushes the plugging devices 40 out of the tool 24. A displacement velocity of the piston 68 may be maintained substantially constant due to the regulated fluid 64 flow through the metering device 66.

In some examples, the tool 24 may include a pump 74 for transferring fluid 64 to displace plugging devices 40 out of the tool. In other examples, the tool 24 may utilize hydrostatic pressure in a well to displace plugging devices 40 out of the tool. In further examples, the tool 24 may utilize an atmospheric (or other low pressure) chamber 80 to displace plugging devices 40 out of the tool.

A plug deployment tool 24, system 10 and method are described above, in which the tool is part of a bottom hole assembly 12 that is conveyed in a well by wireline, slickline, coiled tubing, segmented tubing, an autonomous vehicle, a tractor, a robot, or another type of conveyance 16, or fluid flow 36. The tool 24 may dispense solid bodies, powdered or particulate material, or gel downhole in a controlled manner. In some examples, the tool 24 dispenses plugging devices 40 (of any type) downhole after a zone has been fractured and prior to another zone being placed in communication with a wellbore 14.

The above disclosure provides to the art a method of deploying plugging devices 40 into a subterranean well. In one example, the method can comprise: conveying a bottom hole assembly 12 into the well, the bottom hole assembly 12 comprising a plug deployment tool 24; and actuating the plug deployment tool 24, thereby gradually dispensing the plugging devices 40 from an interior of the plug deployment tool 24 into the well.

The actuating step may comprise igniting a pyrotechnic power charge 60. Pressure generated by ignition of the power charge 60 may act on a piston 68, 106, 112. The dispensing step may comprise the piston 68, 106, 112 displacing the plugging devices 40 out of the plug deployment tool 24. The piston 68, 106, 112 may displace all of the plugging devices 40 out of the plug deployment tool 24 simultaneously, or at discrete intervals.

The plug deployment tool 24 may comprise a fluid metering device 66. The dispensing step may comprise metering a fluid 64 through the fluid metering device 66, thereby regulating displacement of the piston 68, 106.

The actuating step may comprise opening a chamber 80 of the plug deployment tool 24, the chamber 80 containing pressure less than a hydrostatic pressure in the well at the plug deployment tool 24. The opening step may comprise igniting an initiator 58 of the plug deployment tool 24.

The actuating step may comprise operating a fluid pump 74 of the plug deployment tool 24.

The dispensing step may comprise displacing the plugging devices 40 out of the plug deployment tool 24 at discrete intervals.

The method may include fracturing a formation 34 of the well. The actuating step may be performed after the fracturing step.

The bottom hole assembly 12 may comprise a perforator 22. The method may comprise connecting the plug deployment tool 24 uphole or downhole of the perforator 22. The bottom hole assembly 12 may comprise multiple perforators 22, and the method may comprise connecting the plug deployment tool 24 between two of the perforators 22.

The above disclosure also provides to the art a plug deployment tool 24 for use in a subterranean well. In one example, the plug deployment tool 24 can comprise an outer housing 50, 110, multiple plugging devices 40 contained in the outer housing 50, 110, a power charge 60, and a piston 68, 106, 112 configured to displace the plugging devices 40 out of the outer housing 50, 110 in response to ignition of the power charge 60.

The plug deployment tool 24 may comprise a fluid metering device 66 connected between the power charge 60 and the piston 68.

The plug deployment tool 24 may comprise a retainer 70 configured to releasably retain the plugging devices 40 in the outer housing 50, 110 until the power charge 60 is ignited.

The plug deployment tool 24 may comprise multiple axially spaced apart rings 114 releasably secured in the outer housing 110 by shear members 116. The rings 114 may be configured to be contacted in succession by displacement of the piston 112 in response to the ignition of the power charge 60.

The piston 68, 106, 112 may displace all of the plugging devices 40 out of the outer housing 50, 119 simultaneously in response to the ignition of the power charge 60. The piston 68, 106, 112 may displace the plugging devices 40 out of the outer housing 50, 110 at discrete intervals in response to the ignition of the power charge 60.

In another example, a plug deployment tool 24 can comprise a first piston 68 positioned in an outer housing 50, multiple plugging devices 40 disposed in the outer housing 50, and a fluid pump 74 configured to pump fluid 64 into the outer housing 50 and thereby displace the first piston 68 to dispense the plugging devices 40 from the outer housing 50.

The plug deployment tool 24 may comprise a retainer 70 connected at a downhole end of the outer housing 50. The retainer 70 may releasably retain the plugging devices 40 in the outer housing 50.

The plug deployment tool 24 may comprise a second piston 62, the fluid 64 being contained between the fluid pump 74 and the second piston 62. The first and second pistons 68, 62 may be pressure balanced.

The fluid pump 74 may be connected to an electrical conductor 56 that extends through a conveyance 16 configured to convey the plug deployment tool 24 in the well.

In another example, a plug deployment tool 24 can comprise an atmospheric chamber 80, an openable closure 86 that isolates the atmospheric chamber 80 from a fluid volume 88, multiple plugging devices 40 contained in an outer housing 50, and a piston 106 configured to displace the plugging devices 40 out of the outer housing 50 in response to the closure 86 being opened.

The plug deployment tool 24 may comprise a fluid metering device 66 configured to meter fluid flow into the atmospheric chamber 80 in response to the closure 86 being opened.

The plug deployment tool 24 may comprise an initiator 58 configured to open the closure 86 in response to ignition of the initiator 58. The plug deployment tool 24 may comprise a piercing member 90 configured to pierce the closure 86 in response to ignition of the initiator 58. The initiator 58 may be connected to an electrical conductor 56 that extends through a conveyance 16 configured to convey the plug deployment tool 24 in the well.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of deploying plugging devices into a subterranean well, the method comprising: conveying a bottom hole assembly into the well, the bottom hole assembly comprising a plug deployment tool, in which the plug deployment tool comprises a magazine containing multiple plugging devices; and actuating the plug deployment tool, thereby pushing the magazine outward from the plug deployment tool in a controlled manner to a fully extended position and gradually dispensing the plugging devices from an interior of the plug deployment tool into the well, wherein the magazine remains attached to the plug deployment tool in the fully extended position.

2. The method of claim 1, in which the actuating comprises igniting a power charge.

3. The method of claim 2, in which pressure generated by ignition of the power charge acts on a piston, and in which the dispensing comprises the piston displacing the magazine out of the plug deployment tool.

4. The method of claim 3, in which the piston displaces all of the plugging devices out of the plug deployment tool.

5. The method of claim 3, in which the plug deployment tool comprises a fluid metering device, and in which the fluid metering device regulates a rate of displacement of the piston.

6. The method of claim 1, in which the actuating comprises opening a chamber of the plug deployment tool, the chamber containing pressure less than a hydrostatic pressure in the well at the plug deployment tool.

7. The method of claim 6, in which the opening comprises igniting an initiator of the plug deployment tool.

8. The method of claim 1, in which the actuating comprises operating a fluid pump of the plug deployment tool.

9. The method of claim 1, further comprising fracturing a formation of the well, and in which the actuating is performed after the fracturing.

10. The method of claim 1, in which the bottom hole assembly further comprises a perforator, and further comprising connecting the plug deployment tool downhole of the perforator.

11. The method of claim 1, in which the bottom hole assembly further comprises a perforator, and further comprising connecting the plug deployment tool uphole of the perforator.

12. The method of claim 1, in which the bottom hole assembly further comprises at least first and second perforators, and further comprising connecting the plug deployment tool between the first and second perforators.

13. A plug deployment tool for use in a subterranean well, the plug deployment tool comprising:

an outer housing;

a magazine contained in the outer housing, in which the magazine contains multiple plugging devices;

a power charge; and a piston configured to displace the magazine out of the outer housing to a fully extended position in a controlled manner in response to ignition of the power charge, whereby the plugging devices are gradually dispensed into the well, wherein the magazine remains attached to the plug deployment tool in the fully extended position.

14. The plug deployment tool of claim 13, further comprising a retainer configured to releasably retain the plugging devices in the outer housing until the power charge is ignited.

15. The plug deployment tool of claim 13, in which the piston displaces all of the plugging devices out of the outer housing in response to the ignition of the power charge.

16. The plug deployment tool of claim 13, further comprising a fluid metering device connected between the power charge and the piston.

* * * * *